US008066528B1

(12) United States Patent
Hsu et al.

(10) Patent No.: US 8,066,528 B1
(45) Date of Patent: Nov. 29, 2011

(54) CARD CONNECTOR

(75) Inventors: Ya-Hui Hsu, Taoyuan County (TW); Mei-Chuan Yang, Taoyuan County (TW)

(73) Assignee: Proconn Technology Co., Ltd., Taoyuan Country (TW)

( * ) Notice: Subject to any disclaimer, the term of this patent is extended or adjusted under 35 U.S.C. 154(b) by 0 days.

(21) Appl. No.: 13/005,185

(22) Filed: Jan. 12, 2011

(51) Int. Cl.
*H01R 13/648* (2006.01)

(52) U.S. Cl. ..... 439/607.01

(58) Field of Classification Search ..... 439/607.01–607.04, 607.22–607.25
See application file for complete search history.

(56) References Cited

U.S. PATENT DOCUMENTS 6,247,968 B1 * 6/2001 Wu ..... 439/607.22
6,766,394 B1 * 7/2004 Shimura et al. ..... 710/100
7,128,613 B1 * 10/2006 Lee et al. ..... 439/630
D547,728 S * 7/2007 Lee et al. ..... D13/147
7,335,039 B2 * 2/2008 Wang et al. ..... 439/159
7,381,068 B1 * 6/2008 Lin et al. ..... 439/136
7,416,428 B1 * 8/2008 Hung et al. ..... 439/188
7,448,889 B1 * 11/2008 Ho et al. ..... 439/159
7,465,194 B1 * 12/2008 Ho et al. ..... 439/607.01
7,654,868 B1 * 2/2010 Wang et al. ..... 439/630
7,695,304 B2 * 4/2010 Chiang et al. ..... 439/353
2006/0040558 A1 * 2/2006 Ho ..... 439/607
2007/0177357 A1 * 8/2007 Wakabayashi et al. ..... 361/719
2008/0090437 A1 * 4/2008 Huang et al. ..... 439/188
2008/0158829 A1 * 7/2008 Wakabayashi et al. ..... 361/719
2010/0029136 A1 * 2/2010 Wang et al. ..... 439/630
2011/0124212 A1 * 5/2011 Naito et al. ..... 439/155
2011/0151695 A1 * 6/2011 Yang ..... 439/159

* cited by examiner

*Primary Examiner* — Tulsidas C Patel
*Assistant Examiner* — Vladimir Imas
(74) *Attorney, Agent, or Firm* — WPAT, P.C.; Anthony King

(57) ABSTRACT

A card connector includes an insulating housing which defines a first inserting groove and two soldering openings opened behind the first inserting groove with top ends thereof communicating with the first inserting groove. A plurality of first signal terminals is disposed in the base portion and each has a contacting portion exposed in the first inserting groove and a soldering tail projecting in the soldering opening. A main shell enclosing the insulating housing has a base plate covered on the first inserting groove, and a monitoring gap opened in a rear of the base plate and facing the soldering openings. An auxiliary shell, enclosing the soldering openings after the soldering tails are soldered to a printed circuit board, has a top shielding plate mated with the monitoring gap to cover tops of the soldering openings, and a rear shielding plate covering rears of the soldering openings.

7 Claims, 3 Drawing Sheets

CARD CONNECTOR

BACKGROUND OF THE INVENTION

1. Field of the Invention

The present invention relates to a connector, and particularly to a card connector.

2. The Related Art

A conventional card connector usually has an insulating housing, a plurality of signal terminals which are mounted in the insulating housing, and a shell enclosing the insulating housing. Each signal terminal has a soldering tail for soldering to a printed circuit board. In order to solder the soldering tails to the printed circuit board, the soldering tails are always exposed out of the insulating housing or a soldering opening is opened at the insulating housing for receiving the soldering tails therein.

No matter the soldering tails are exposed out of the insulating housing or the soldering opening is opened at the insulating housing for receiving the soldering tails, it is necessary to define a monitoring gap in the shell for monitoring soldering conditions between the soldering tails and the printed circuit board. However, the monitoring gap causes the soldering tails to be exposed outside without being enclosed by the shell. As a result, electromagnetic interference is often apt to happen during the signal transmission between the card connector and the printed circuit board.

SUMMARY OF THE INVENTION

Accordingly, an object of the present invention is to provide a card connector mounted on a printed circuit board. The card connector includes an insulating housing which has a base portion. A top surface of the base portion defines a first inserting groove. A rear end of the base portion defines two soldering openings which are spaced from each other and opened behind the first inserting groove with top ends thereof communicating with the first inserting groove. A supporting portion is formed between the two soldering openings. A plurality of first signal terminals are disposed in base portion of the insulating housing and each of the first signal terminals has a contacting portion exposed in the first inserting groove and a soldering tail projecting rearward in the corresponding soldering opening for soldering to the printed circuit board. A main shell encloses the insulating housing and has a base plate covered on the first inserting groove. The base plate defines a monitoring gap corresponding to the two soldering openings of the insulating housing for monitoring soldering conditions between the soldering tails and the printed circuit board. An auxiliary shell has a top shielding plate and a rear shielding plate connected with a rear edge of the top shielding plate. The auxiliary shell is mounted to the rear end of the insulating housing to enclose the soldering openings of the insulating housing after the soldering tails are soldered to the printed circuit board, with the top shielding plate being mated with the monitoring gap of the base plate of the main shell to cover tops of the soldering openings, and the rear shielding plate being against a rear side of the supporting portion to cover rears of the soldering openings.

As described above, the card connector utilizes the auxiliary shell to enclose the soldering openings of the base portion and cooperate with the main shell to make the soldering tails of the first signal terminals never be exposed outside. So, the electromagnetic interference can be effectively shielded by means of the cooperation between the main shell and the auxiliary shell during the signal transmission between the card connector and the printed circuit board.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
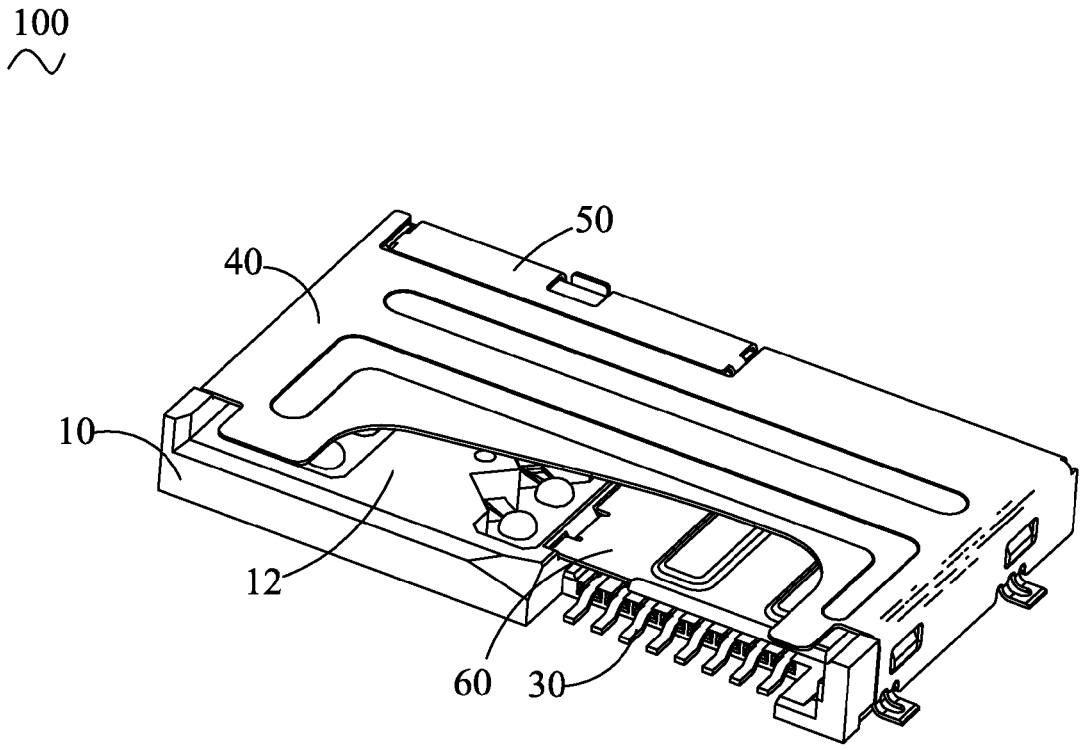
FIG. 1 is an assembled perspective view of a card connector in accordance with the present invention.
Figure 2:
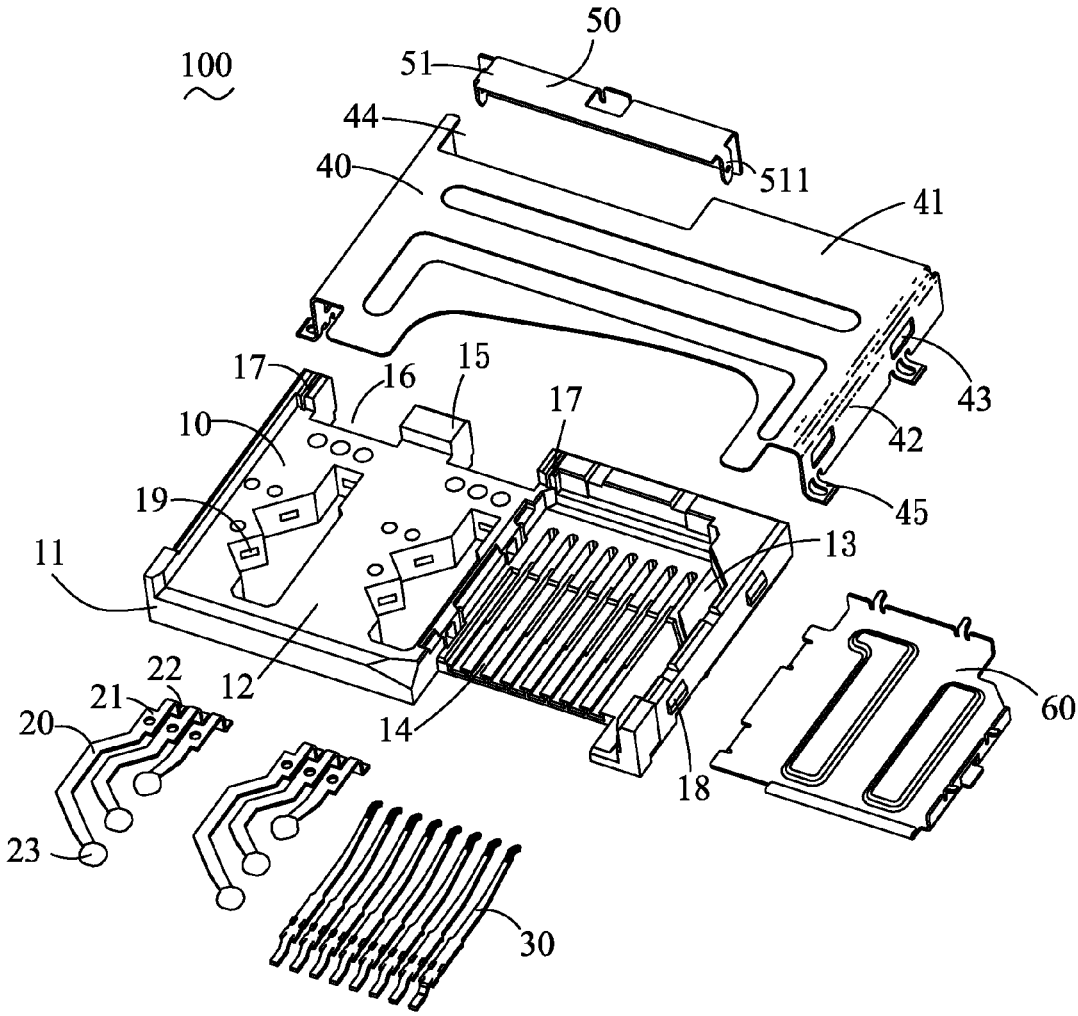
FIG. 2 is an exploded, perspective view of the card connector of FIG. 1.

Referring to the drawings in greater detail, and first to FIG. 1 and FIG. 2, the embodiment of the invention is embodied in a card connector 100. The card connector 100 has an insulating housing 10, a plurality of first signal terminals 20, a plurality of second signal terminals 30, a main shell 40, an auxiliary shell 50 and a separating board 60.

Referring to FIG. 1 and FIG. 2 again, the insulating housing 10 has a substantially rectangular base portion 11. A top surface of the base portion 11 defines a rectangular first inserting groove 12 and a substantially rectangular second inserting groove 13 adjacent to the first inserting groove 12 and aligned with the first inserting groove 12 along a longwise direction of the base portion 11. In this embodiment, the second inserting groove 13 has a deeper depth than that of the first inserting groove 12. Both the first inserting groove 12 and the second inserting groove 13 penetrate through a front end of the base portion 11. A bottom side of the second inserting groove 13 defines a plurality of second signal terminal grooves 14 arranged at regular intervals along the longwise direction of the base portion 11 and each extending along a front-to-rear direction to penetrate through the front end of the bottom side of the second inserting groove 13. A rear end of the base portion 11 defines two soldering openings 16 which are spaced from each other and opened behind the first inserting groove 12, with top ends thereof communicating with the first inserting groove 12. A supporting portion 15 is formed between the two soldering openings 16. The rear end of the base portion 11 defines two fastening grooves 17 located at two sides of the two soldering openings 16 and each penetrating though the top surface of the base portion 11. In this embodiment, the fastening grooves 17 and the two soldering openings 16 are aligned with one another along the longwise direction of the base portion 11. Two opposite side surfaces of the base portion 11 respectively protrude outward to form a pair of buckling blocks 18. A bottom side of the first inserting groove 12 defines a plurality of first signal terminal grooves 19 communicating with the soldering openings 16 and the first inserting groove 12.

Referring to FIG. 2, each of the first signal terminals 20 has a fixing plate 21 mounted in the first signal terminal groove 19, a substantially L-shaped soldering tail 22 extended and bent from a rear end of the fixing plate 21 and projecting rearward in the corresponding soldering opening 16 for soldering to a printed circuit board (not shown), and a contacting portion 23 formed at a front end of the fixing plate 21 and elastically exposed in the first inserting groove 12.

Referring to FIG. 2 again, the main shell 40 has a substantially rectangular base plate 41 covered on the first inserting groove 12 and the second inserting groove 13, and two lateral plates 42 extended downward from two opposite lateral edges of the base plate 41 and abutting against the two opposite side surfaces of the base portion 11. A pair of buckling recesses 43 is opened at each lateral plate 42 for buckling the corresponding buckling blocks 18 of the base portion 11 therein. A pair of soldering feet 45 extends outward from a bottom edge of each lateral plate 42 for soldering to the printed circuit board. A rear portion of the base plate 41 defines a monitoring gap 44 corresponding to the two soldering openings 16 of the insulating housing 10 for monitoring soldering conditions between the soldering tails 22 and the printed circuit board.

Figure 3:
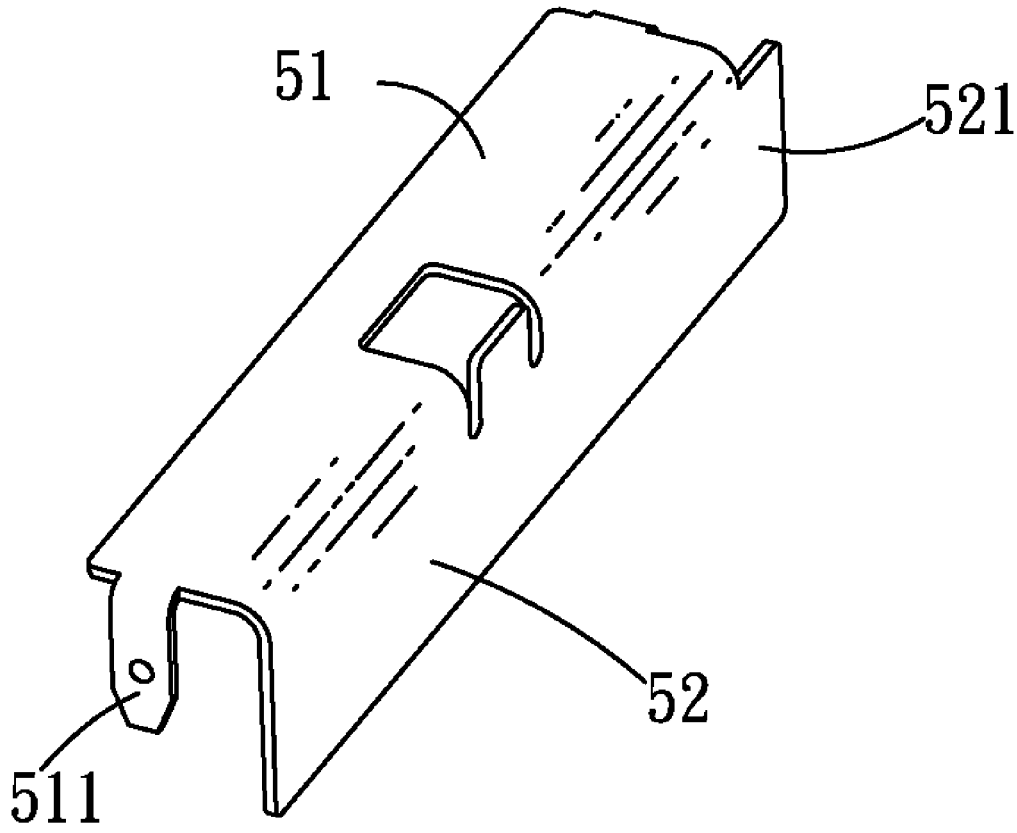
FIG. 3 is a perspective view of an auxiliary shell of the card connector shown in FIG. 2.

Referring to FIGS. 2-3, the auxiliary shell 50 has a top shielding plate 51 and a rear shielding plate 52 perpendicularly connected with a rear edge of the top shielding plate 51 to make the auxiliary shell 50 show an inverted-L shape. One end edge of the rear shielding plate 52 further extends sideward to form a propping plate 521 abutting against a rear side of the base portion 11. Two opposite end edges of the top shielding plate 51 extend downward to form two fastening portions 511.

Referring to FIGS. 1-3, in assembly, the fixing plates 21 of the first signal terminals 20 are fixed in the first signal terminal grooves 19 of the base portion 11. The soldering tails 22 of the first signal terminals 20 project into the corresponding soldering openings 16 of the base portion 11 for soldering to the printed circuit board. The contacting portions 23 of the first signal terminals 20 are elastically exposed in the first inserting groove 12 of the base portion 11 for contacting with a card (not shown). The second signal terminals 30 are fixed in the second signal terminal grooves 14 of the base portion 11 and further project in the second inserting groove 13. The separating board 60 is assembled in the second inserting groove 13 and has a top surface thereof substantially keep abreast with the bottom side of the first inserting groove 12. The main shell 40 encloses outsides of the insulating housing 10, with the base plate 41 covering the first inserting groove 12 and the second inserting groove 13, and the lateral plates 42 abutting against the corresponding side surfaces of the base portion 11. The buckling blocks 18 of the insulating housing 10 are buckled in the buckling recesses 43 of the main shell 40. The monitoring gap 44 faces the soldering openings 16 of the insulating housing 10 to monitor the soldering conditions between the soldering tails 22 of the first signal terminals 20 and the printed circuit board. The auxiliary shell 50 is mounted to the rear end of the insulating housing 10 and encloses the soldering openings 16 of the insulating housing 10 after the soldering tails 22 are soldered to the printed circuit board. The top shielding plate 51 of the auxiliary shell 50 is mated with the monitoring gap 44 of the base plate 41 of the main shell 40 to cover tops of the soldering openings 16, and the rear shielding plate 52 of the auxiliary shell 50 is against a rear side of the supporting portion 15 to cover rears of the soldering openings 16. The fastening portions 511 of the top shielding plate 51 are fastened in the fastening grooves 17 of the insulating housing 10 respectively. The propping plate 521 of the rear shielding plate 52 abuts against the rear side of the base portion 10.

As described above, the card connector 100 utilizes the auxiliary shell 50 to enclose the soldering openings 16 of the base portion 10 and cooperate with the main shell 40 to make the soldering tails 22 of the first signal terminals 20 never be exposed outside. So, the electromagnetic interference can be effectively shielded by means of the cooperation between the main shell 40 and the auxiliary shell 50 during the signal transmission between the card connector 100 and the printed circuit board.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A card connector mounted on a printed circuit board, comprising:

an insulating housing having a base portion, a top surface of the base portion defining a first inserting groove, a rear end of the base portion defining two soldering openings which are spaced from each other and opened behind the first inserting groove with top ends thereof communicating with the first inserting groove, a supporting portion being formed between the two soldering openings;

a plurality of first signal terminals disposed in base portion of the insulating housing, each of the first signal terminals having a contacting portion exposed in the first inserting groove and a soldering tail projecting rearward in the corresponding soldering opening for soldering to the printed circuit board;

a main shell enclosing the insulating housing and having a base plate covered on the first inserting groove, the base plate defining a monitoring gap corresponding to the two soldering openings of the insulating housing for monitoring soldering conditions between the soldering tails and the printed circuit board; and an auxiliary shell having a top shielding plate and a rear shielding plate connected with a rear edge of the top shielding plate, wherein the auxiliary shell is mounted to the rear end of the insulating housing to enclose the soldering openings of the insulating housing after the soldering tails are soldered to the printed circuit board, with the top shielding plate being mated with the monitoring gap of the base plate of the main shell to cover tops of the soldering openings, and the rear shielding plate being against a rear side of the supporting portion to cover rears of the soldering openings.

2. The card connector as claimed in claim 1, wherein the rear shielding plate is perpendicularly connected with the top shielding plate to make the auxiliary shell show an inverted-L shape.

3. The card connector as claimed in claim 1, wherein two opposite end edges of the top shielding plate extend downward to form two fastening portions, the rear end of the base portion defines two fastening grooves located at two sides of the two soldering openings and each penetrating through the top surface of the base portion, the fastening portions are fastened in the fastening grooves respectively.

4. The card connector as claimed in claim 1, wherein one end edge of the rear shielding plate extends sideward to form a propping plate abutting against a rear side of the base portion.

5. The card connector as claimed in claim 1, wherein two opposite side surfaces of the base portion respectively protrude outward to form a pair of buckling blocks, the main shell has two lateral plates extended downward from two opposite lateral edges of the base plate and abutting against the two opposite side surfaces of the base portion, a pair of buckling recesses is opened at each lateral plate for buckling the corresponding buckling blocks of the base portion therein.

6. The card connector as claimed in claim 1, wherein the top surface of the base portion of the insulating housing further defines a second inserting groove adjacent to the first inserting groove, the card connector further includes a plurality of second signal terminals disposed in a bottom side of the second inserting groove and further projecting in the second inserting groove.

7. The card connector as claimed in claim 6, wherein the second inserting groove has a deeper depth than that of the first inserting groove, the card connector further includes a separating board assembled in the second inserting groove, with a top surface thereof substantially abreast with a bottom side of the first inserting groove and apart from the base plate of the main shell.

* * * * *